US009448527B1

(12) United States Patent
Ninomiya

(10) Patent No.: US 9,448,527 B1
(45) Date of Patent: Sep. 20, 2016

(54) DRIVING FORCE TRANSMISSION MECHANISM AND IMAGE FORMING APPARATUS

(71) Applicant: FUJI XEROX CO., LTD., Tokyo (JP)

(72) Inventor: Yosuke Ninomiya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/804,773

(22) Filed: Jul. 21, 2015

(30) Foreign Application Priority Data

Mar. 24, 2015 (JP) ..... 2015-060287

(51) Int. Cl.
*G03G 15/00* (2006.01)
*G03G 21/16* (2006.01)

(52) U.S. Cl.
CPC ..... *G03G 21/1647* (2013.01)

(58) Field of Classification Search
CPC ..... G03G 21/1647
USPC ..... 399/167, 259
See application file for complete search history.

(56) References Cited

U.S. PATENT DOCUMENTS 7,242,890 B2 7/2007 Yokota
2006/0093398 A1 5/2006 Hayakawa
2010/0272470 A1* 10/2010 Tomatsu ..... G03G 21/1647 399/167

FOREIGN PATENT DOCUMENTS

JP 2005-338146 A 12/2005
JP 2006-154746 A 6/2006
JP 2011-059617 A 3/2011

* cited by examiner

*Primary Examiner* — David Bolduc
*Assistant Examiner* — Barnabas Fekete
(74) *Attorney, Agent, or Firm* — Oliff PLC

(57) ABSTRACT

A driving force transmission mechanism includes a body that includes a transmission member, which transmits a driving force and includes a rotatable first surface and two first projections, and an installation unit that includes a receiving member including a second surface, which faces the first surface and which is rotatable by receiving the force when the installation unit is installed, and two second projections, which receive the force from the first projections by contacting the first projections when the first surface rotates, and that is removably installed in the body in a direction, in which the second surface moves parallel to the first surface, to couple the transmission member and the receiving member. The body includes a contact member that contacts, to rotate the receiving member, one of the second projections when the installation unit is installed while a line segment connecting the second projections is intersecting an installation direction.

16 Claims, 6 Drawing Sheets

DRIVING FORCE TRANSMISSION MECHANISM AND IMAGE FORMING APPARATUS

CROSS-REFERENCE TO RELATED APPLICATIONS

This application is based on and claims priority under 35 USC 119 from Japanese Patent Application No. 2015-060287 filed Mar. 24, 2015.

BACKGROUND

Technical Field

The present invention relates to a driving force transmission mechanism and an image forming apparatus.

SUMMARY

According to an aspect of the invention, there is provided a driving force transmission mechanism including a body including a transmission member that transmits a driving force and includes a first surface, which rotates, and two first projections that project from the first surface at positions, each of which is spaced apart from a center of rotation of the first surface and an installation unit that includes a receiving member including a second surface, which faces the first surface and which rotates as a result of receiving the driving force in a state where the installation unit is installed in the body, and two second projections, which project from the second surface at positions each of which is spaced apart from a center of rotation of the second surface and which receive the driving force from the first projections by being in contact with the first projections in accordance with rotation of the first surface, and that is configured to be removably installed in the body in a direction in which the second surface moves parallel to the first surface in such a manner that the transmission member and the receiving member are coupled to each other. The body further includes a contact member that is brought into contact with one of the second projections when the installation unit is installed in the body in a state where a line segment connecting the second projections intersects an installation direction in which the installation unit is installed in the body and that causes the receiving member to rotate.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below.

Figure 1:
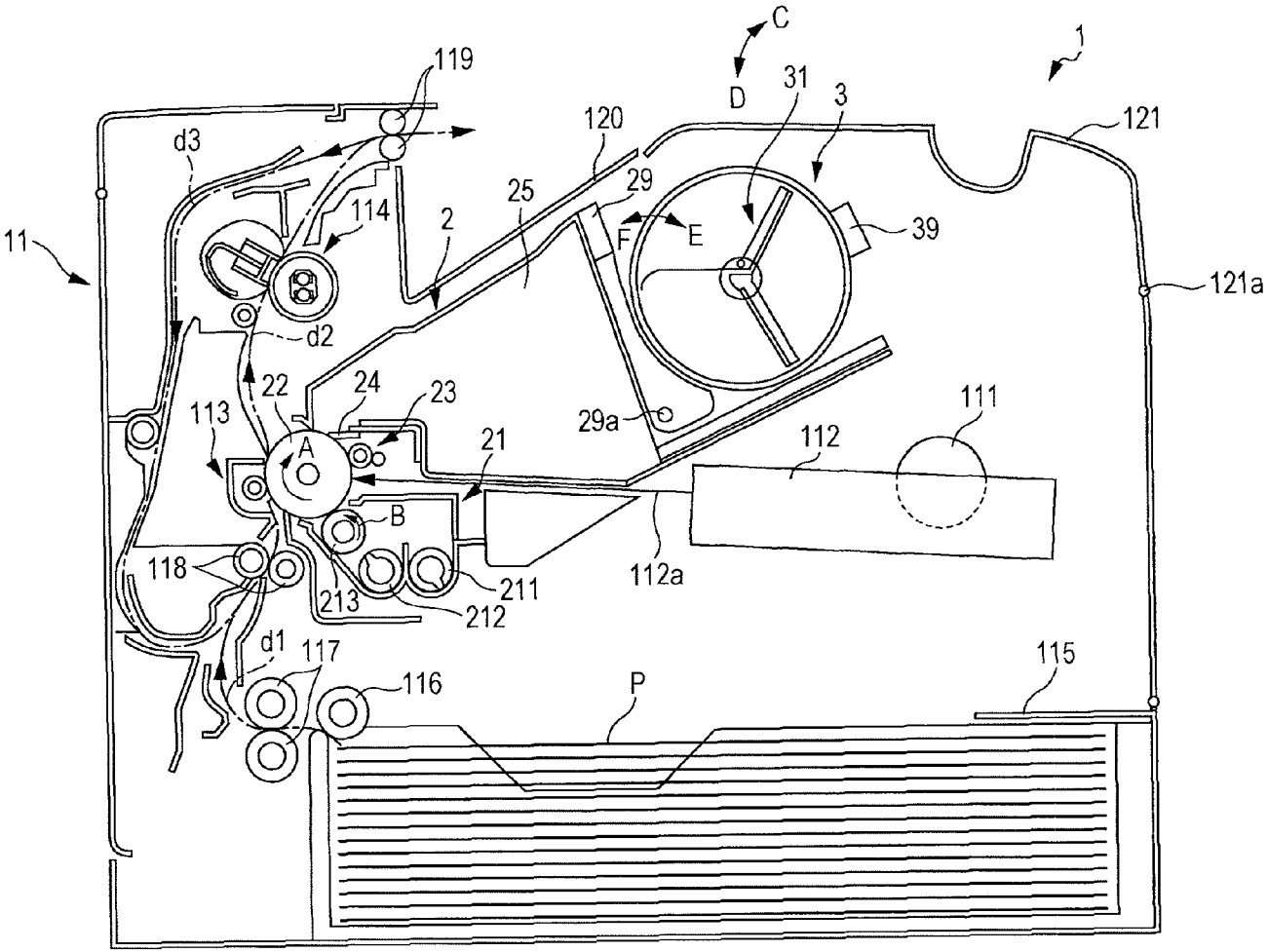
FIG. 1 is a schematic diagram illustrating a printer, which is an exemplary embodiment of an image forming apparatus of the present invention.

FIG. 1 is a schematic diagram illustrating a printer, which is an exemplary embodiment of an image forming apparatus of the present invention. A device, which is an exemplary embodiment of a driving force transmission device of the present invention, is incorporated within the printer.

A printer 1 illustrated in FIG. 1 is a printer that employs an electrophotographic system and prints an image on one of sheets P, and a side surface of the printer 1 on the right side in FIG. 1 is a front surface of the printer 1. In the printer 1, a process cartridge 2 is installed in a printer body 11 so as to be removable from the printer body 11 on the side on which the front surface of the printer 1 is present. In addition, a toner cartridge 3 is installed diagonally above a front surface of the process cartridge 2 so as to be removable from the printer body 11 on the side on which the front surface of the printer 1 is present.

Here, the printer body 11 corresponds to an example of a body, and the toner cartridge 3 corresponds to an example of an installation unit.

The toner cartridge 3 contains a replenishing toner, and this toner in the toner cartridge 3 is stirred as a result of rotation of a stirring member 31, so that the toner is prevented from coagulating. A driving force is transmitted to the stirring member 31 from a motor 111, which is provided in the printer body 11, via a driving force transmission mechanism (not illustrated). The toner in the toner cartridge 3 is supplied to a developing unit 21, which is included in the process cartridge 2.

In addition to the developing unit 21, the process cartridge 2 includes a photoconductor 22, a charger 23, and a cleaner 24. A waste-toner containing chamber 25 that contains waste toner, which is scraped off from the photoconductor 22 by the cleaner 24, is disposed between the developing unit 21 and the photoconductor 22 and the toner cartridge 3.

The printer body 11 further includes an exposure unit 112 that radiates exposure light 112*a* onto the photoconductor 22 and a transfer unit 113 that is disposed at a position facing the photoconductor 22.

The photoconductor 22 is subjected to various operations described below while rotating in the direction of arrow A.

The charger 23 charges a surface of the photoconductor 22 to a predetermined potential.

The exposure unit 112 radiates the exposure light 112*a*, which corresponds to an image signal, onto the charged surface of the photoconductor 22 so as to form an electrostatic latent image on the surface of the photoconductor 22.

The developing unit 21 contains a developer containing a carrier and a toner and moves circularly in a direction perpendicular to FIG. 1 as a result of rotation of two augers 211 and 212. The developer in the developing unit 21 is delivered to a developing position facing the photoconductor 22 by a developing roller 213 that rotates in the direction of arrow B. An electrostatic latent image on the photoconductor 22 is developed with the toner, which is contained in the developer, and a toner image is formed on the photoconductor 22. The toner image formed on the photoconductor 22 is transferred onto one of the sheets P, which is transported in a manner described later, by operation of the transfer unit 113. The toner image on the sheet P is heated and pressurized by a fixing unit 114 provided in the printer body 11 and fixed onto the sheet P.

A sheet cartridge 115 is mounted in a lower portion of the printer body 11 in such a manner as to be capable of being drawn out toward the right side in FIG. 1, and the sheets P, on each of which an image is to be printed, are accommodated in the sheet cartridge 115 in such a manner as to be stacked on top of one another. When a printing operation is performed, one of the sheets P accommodated in the sheet cartridge 115, the sheet P being at the top of the sheets P, is taken out by a take-out roller 116. Even in the case where some of the sheets P are taken out while superposed with each other, separation rollers 117 separate the sheets P one by one with certainty, and only one of the sheets P is transported along a transport path d1 and reaches registration rollers 118. The registration rollers 118 correct the position of the sheet P, which has been transported, and send out the sheet P to a further downstream side by adjusting the timing of subsequent transportation of the sheet P. The registration rollers 118 send out the sheet P in accordance with the timing at which the toner image on the photoconductor 22 is transferred, and the toner image on the photoconductor 22 is transferred onto the sheet P. The sheet P, to which the toner image has been transferred, is further transported along a transport path d2 in such a manner as to pass through the fixing unit 114, the toner image is fixed onto the sheet P. The sheet P is ejected by sheet ejection rollers 119 into a sheet-ejection tray 120 that is provided in an upper portion of the printer body 11.

In the case of printing an image on the two surfaces of the sheet P, a portion of the sheet P, which has an image printed on one surface thereof in a similar manner to the above, is sent out by the sheet ejection rollers 119. After that, the sheet ejection rollers 119 rotate in a reverse direction, and the sheet P is transported along a transport path d3 and reaches the registration rollers 118 again. Subsequently, the above-described printing operation is repeated, and the sheet P having images printed on the two surfaces thereof is ejected into the sheet-ejection tray 120 by the sheet ejection rollers 119.

A cover 121, which is a portion of a cover of the printer body 11, is capable of being freely opened and closed in the direction of arrow C to arrow D, that is, toward the front surface of the printer 1, with a hinge portion 121*a* acting as a center. When a user opens the cover 121 and draws out the toner cartridge 3 by holding a handle 39, which is included on the toner cartridge 3, in their hand, the toner cartridge 3 is removed from the printer body 11. When the user removes the process cartridge 2 from the printer body 11, after the toner cartridge 3 has been removed from the printer body 11, the user tilts a rotating lever 29, which is included on the process cartridge 2, in such a manner that the rotating lever 29 rotates in the direction of arrow E. The rotating lever 29 is rotatably mounted with a hinge portion 29. However, during the period when the toner cartridge 3 is installed in the printer body 11, the rotating lever 29 is maintained at a first position, which is illustrated in FIG. 1, due to the presence of the toner cartridge 3.

When the process cartridge 2 is installed at a normal position, which is illustrated in FIG. 1, and the rotating lever 29 is located at the first position illustrated in FIG. 1, regardless of the existence of the toner cartridge 3, part of a lower end portion of the process cartridge 2 is hooked on the printer body 11, and accordingly, it is difficult to draw out the process cartridge 2.

In the case of removing the process cartridge 2 from the printer body 11, a user removes the toner cartridge 3 first. After that, the user tilts the rotating lever 29 in the direction of arrow E so as to bring the rotating lever 29 to a second position. Then, the process cartridge 2 is slightly raised by an eccentric cam (not illustrated) that is integrally formed with the rotating lever 29. As a result, the part of the lower end portion of the process cartridge 2, which has been hooked on the printer body 11, is released. Finally, the user draws out the process cartridge 2 by using as a handle the rotating lever 29, which has been tilted so as to be located at the second position as is, and the process cartridge 2 may be removed from the printer body 11. In the case of installing the process cartridge 2, the user performs an operation that is the reverse of the operation for removing the process cartridge 2 from the printer body 11. In other words, the user presses the process cartridge 2 into the printer body 11 by using the rotating lever 29 of the process cartridge 2 as a handle and brings the rotating lever 29 to the first position illustrated in FIG. 1 by rotating the rotating lever 29 in the direction of arrow F. Then, the part of the lower end portion of the process cartridge 2 is hooked on the printer body 11 and prevented from being released from the printer body 11. After that, the user installs the toner cartridge 3 into the printer body 11 by holding the handle 39 of the toner cartridge 3 in their hand and closes the cover 121 of the printer body 11 in the direction of arrow D.

The printer body 11 includes a transmission member that transmits a driving force, which causes the stirring member 31 to rotate, from the motor 111 to the toner cartridge 3. The toner cartridge 3 includes a receiving member that receives the driving force from the transmission member.

The structures of the transmission member and the receiving member and a structure associated therewith will be described below.

Figure 2:
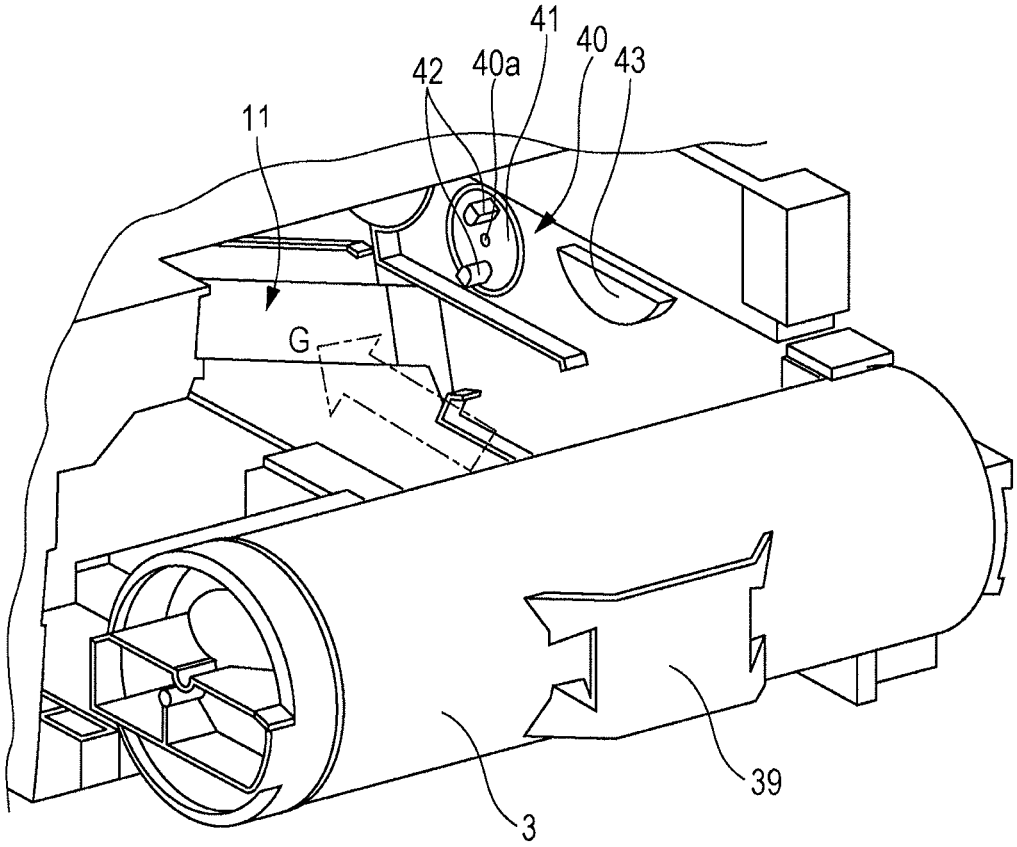
FIG. 2 is a diagram illustrating a transmission member mounted on a printer body.

FIG. 2 is a diagram illustrating a transmission member mounted on the printer body 11.

Figure 3:
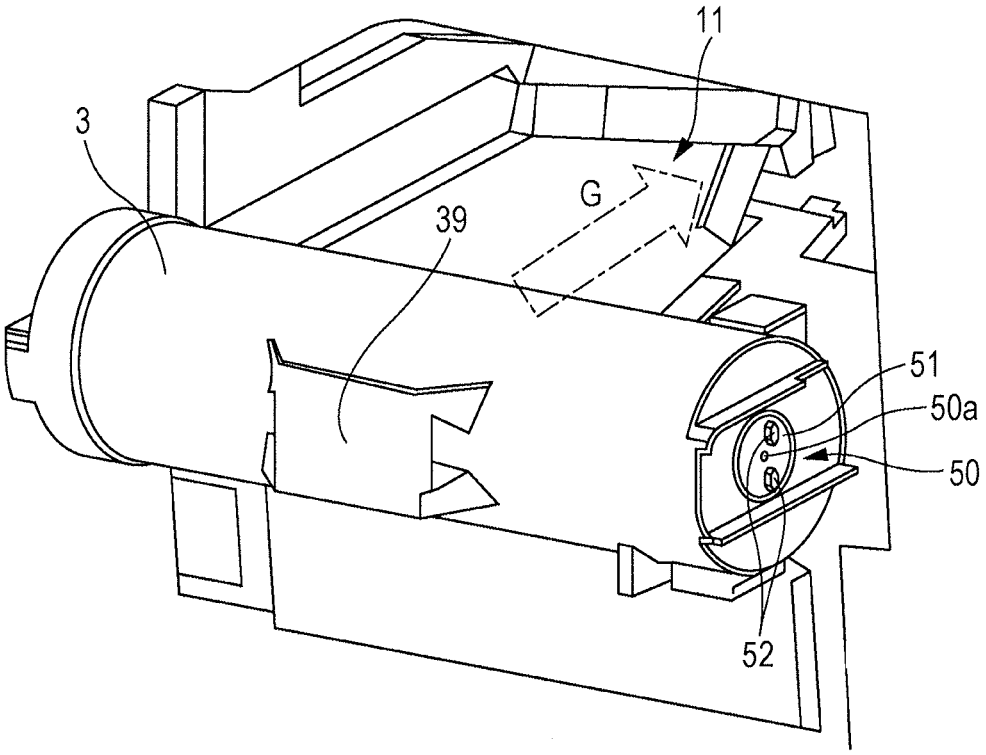
FIG. 3 is a diagram illustrating a receiving member mounted on a toner cartridge.

FIG. 3 is a diagram illustrating a receiving member mounted on the toner cartridge 3.

Although the toner cartridge 3 in the printer 1 according to the present exemplary embodiment is configured to be installed in a diagonal direction from a top side to a bottom side as illustrated in FIG. 1, for ease of understanding, FIG. 2 and FIG. 3 illustrate the toner cartridge 3 as if the toner cartridge 3 is installed in the horizontal direction.

A transmission member 40 illustrated in FIG. 2 has a circular-shaped first surface 41. The first surface 41 receives a driving force from the motor 111 (see FIG. 1) and rotates about a center of rotation 40*a*, which is the center of the first surface 41. The transmission member 40 includes two first projections 42 projecting from the first surface 41 at positions, each of which is spaced apart from the center of rotation 40*a* of the first surface 41 in opposite directions. These two first projections 42 rotate around the center of rotation 40*a* as a result of rotation of the first surface 41. In the printer body 11, a projection 43, which has a portion on its bottom surface side formed in an arc shape, is disposed at a position closer than the transmission member 40 to the proximal side in an installation direction indicated by arrow G. Operation of the projection 43 will be described later. The projection 43 corresponds to an example of a contact member.

A receiving member 50, which is mounted on the toner cartridge 3 and illustrated in FIG. 3, has a circular-shaped second surface 51. When the toner cartridge 3 is installed in the printer body 11, the second surface 51 is located at a position facing the first surface 41 (see FIG. 2) of the transmission member 40 mounted on the printer body 11. The second surface 51 receives a driving force from the transmission member 40 of the printer body 11 and rotates about a center of rotation 50*a*, which is the center of the circular shape.

The receiving member 50 of the toner cartridge 3 includes two second projections 52 projecting from the second surface 51 at positions, each of which is spaced apart from the center of rotation 50*a* of the second surface 51 in substantially opposite directions. Each of the two second projections 52 is brought into contact with a corresponding one of the two first projections 42, which are included in the transmission member 40 of the printer body 11. When the transmission member 40 rotates, the two second projections 52 receive a driving force from the corresponding two first projections 42 and rotate upon the rotations of the first projections 42 so that the second surface 51 rotates. This rotation is transmitted to the stirring member 31, which is disposed in the toner cartridge 3 (see FIG. 1), and consequently, the stirring member 31 rotates.

Coupling of the receiving member 50 to the transmission member 40 in the case of installing the toner cartridge 3 will now be described.

Figure 4A:
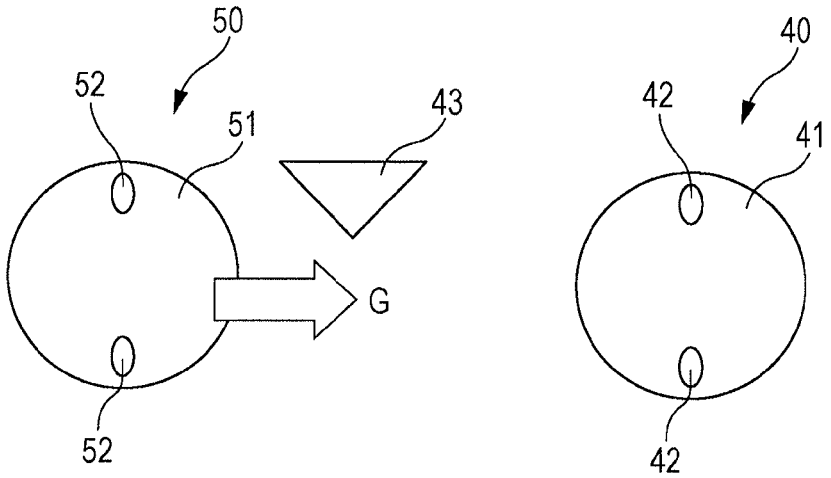
FIGS. 4A to 4C are schematic diagrams illustrating a state in which the receiving member comes closer to the transmission member as a result of an operation of installing the toner cartridge.
Figure 4B:
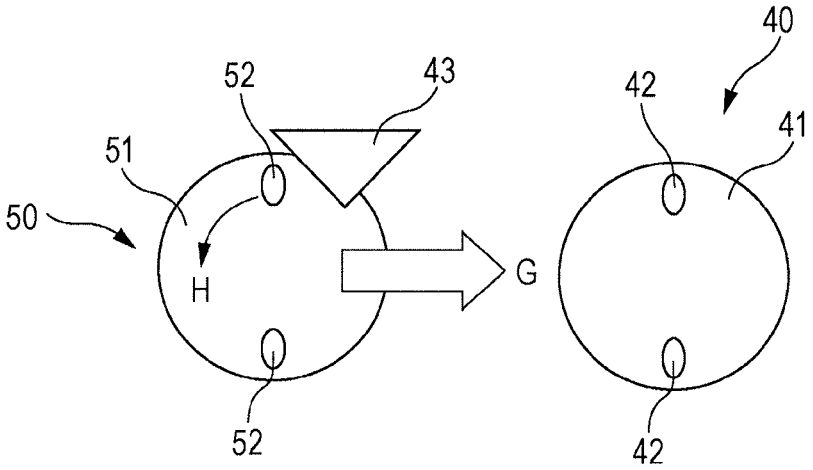
Figure 4C:
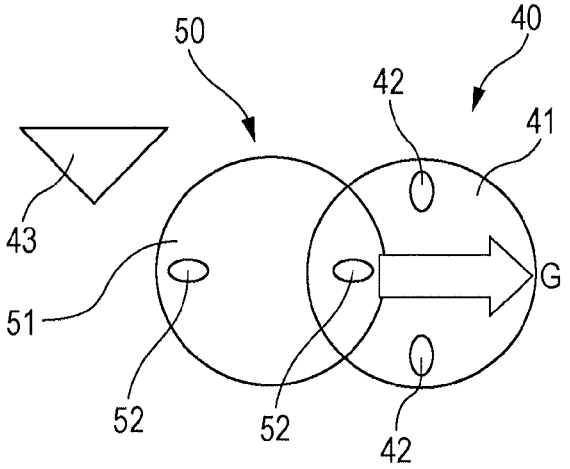

FIGS. 4A to 4C are schematic diagrams illustrating a state in which the receiving member 50 comes closer to the transmission member 40 as a result of an operation of installing the toner cartridge 3.

Here, the transmission member 40 of the printer body 11 is stopped at a position where a line segment connecting the two first projections 42 is perpendicular to an insertion direction indicated by arrow G. The receiving member 50 of the toner cartridge 3 is also located at a position where a line segment connecting the two second projections 52 is perpendicular to the insertion direction indicated by arrow G. In the case where both the transmission member 40 and the receiving member 50 are located at the above-mentioned positions, when the toner cartridge 3 is installed in the direction of arrow G without taking any measures, the two second projections 52 abuts against the corresponding two first projections 42 at approximately the same time, and the installation of the toner cartridge 3 is obstructed. As a result, it is difficult to couple the receiving member 50 to the transmission member 40. Accordingly, in the present exemplary embodiment, in the printer body 11, the projection 43 is disposed at the position closer than the transmission member 40 to the proximal side in the installation direction (indicated by arrow G) (also see FIG. 2).

In the case of installing the toner cartridge 3, as illustrated in FIG. 4A, the receiving member 50 comes closer to the transmission member 40 in the direction of arrow G. Then, as illustrated in FIG. 4B, one of the two second projections 52 of the receiving member 50 abuts against the projection 43 of the printer body 11, and the receiving member 50 rotates in the direction indicated by arrow H. Consequently, as illustrated in FIG. 4C, the toner cartridge 3 is inserted in such a manner that the second surface 51 reaches the normal position facing the first surface 41 while the second projections 52 avoid making contact with the first projections 42.

Figure 5A:
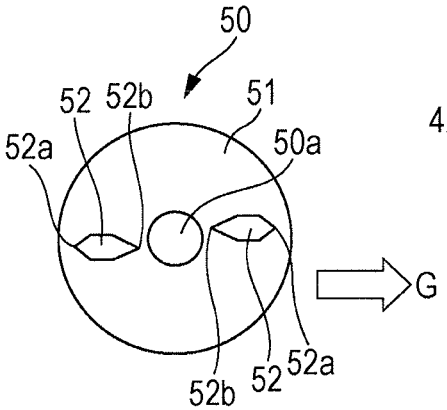
FIGS. 5A and 5B are schematic diagrams respectively illustrating the receiving member and the transmission member.
Figure 5B:
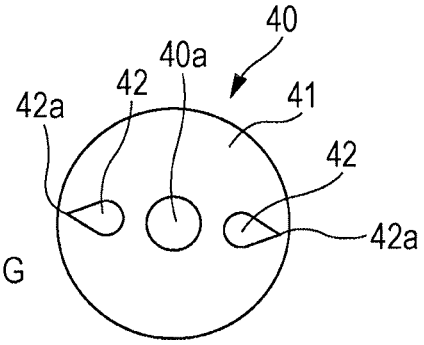

FIGS. 5A and 5B are schematic diagrams respectively illustrating the receiving member 50 and the transmission member 40.

The shapes of the first projections 42 and the second projections 52 will now be described.

The transmission member 40 illustrated in FIG. 5B will be described first. Surfaces of the two first projections 42 of the transmission member 40 facing the center of rotation 40*a* each have an arc shape. In addition, each of the two first projections 42 has a first pointed portion 42*a*, which is tapered in a direction away from the center of rotation 40*a*.

The two second projections 52 of the receiving member 50 illustrated in FIG. 5A are disposed at positions that are slightly offset with respect to the center of rotation 50*a* in order to make a line segment connecting two contact points of the two second projections 52 and the two first projections 42 of the transmission member 40 pass through the center of rotation 50*a*.

Portions of the second projections 52 that come into contact with the corresponding first projections 42 are each formed of a plane that is vertically oriented. On the other hand, each of the first projections 42 is brought into linear contact with the corresponding second projections 52 on a vertical boundary line between the portion of the first projection 42 having an arc shape and the first pointed portion 42*a*. If each of the first projections 42 is formed in a plane so as to be brought into surface contact with the corresponding second projection 52, contact positions will be displaced to a large extent in a radial direction with small tolerance. In the present exemplary embodiment, in order to suppress this from occurring, the first projections 42 are each formed in such a shape so as to come into linear contact with the corresponding second projection 52.

Similar to the first projections 42, each of the second projections 52 has a first pointed portion 52*a*, which is tapered in a direction away from the center of rotation 50*a*. In addition, each of the second projections 52 has a second pointed portion 52*b*, which is tapered in a direction toward the center of rotation 50*a*.

Here, the transmission member 40 and the receiving member 50 are located at positions where one of the second projections 52 that is positioned further toward the proximal side in the installation direction (direction of arrow G) and one of the first projections 42 that is positioned further toward the distal side in the installation direction (direction of arrow G) are arranged side by side in the installation direction (direction of arrow G). The one of the second projections 52 will hereinafter be referred to as a proximal second projection 52, and the one of the first projections 42 will hereinafter be referred to as a distal first projection 42.

While the transmission member 40 and the receiving member 50 are located at these positions, when the toner cartridge 3 is installed, and the receiving member 50 comes closer to the transmission member 40, the first pointed portion 52*a* of the proximal second projection 52 abuts against the first pointed portion 42*a* of the distal first projection 42. Here, since the distal first projection 42 and the proximal second projection 52 have the first pointed portion 42*a*, which is tapered, and the first pointed portion 52*a*, which is tapered, respectively, when the first pointed portion 52*a* comes into contact with the first pointed portion 42*a*, the receiving member 50 rotates in one of two directions. Consequently, when the toner cartridge 3 is inserted further in the installation direction (direction of arrow G), the receiving member 50 and the transmission member 40 are coupled to each other.

When the receiving member 50 rotates slightly as a result of the proximal second projection 52 coming into contact with the distal first projection 42, and the toner cartridge 3 is inserted more deeply, or when the transmission member 40 is located at a position where the transmission member 40 reaches after rotating slightly from the position illustrated in FIG. 5B, and the toner cartridge 3 is inserted more deeply without contact between the proximal second projection 52 and the distal first projection 42, a situation may be assumed in which the other one of the second projections 52 that is positioned further toward the distal side in the installation direction (direction of arrow G) comes into contact with the distal first projection 42. The other one of the second projections 52 will hereinafter be referred to as a distal second projection 52.

In this case, the second pointed portion 52*b* of the distal second projection 52 facing the center of rotation 50*a* comes into contact with the first pointed portion 42*a* of the distal first projection 42. Accordingly, also in this case, contact is made between portions each of which is tapered, and when the toner cartridge 3 is inserted further deeply as is, the receiving member 50 and the transmission member 40 are coupled to each other.

A relationship between the distance between the two first projections 42, which are included in the transmission member 40, and the distance between the two second projections 52, which are included in the receiving member 50, will now be described.

Figure 6:
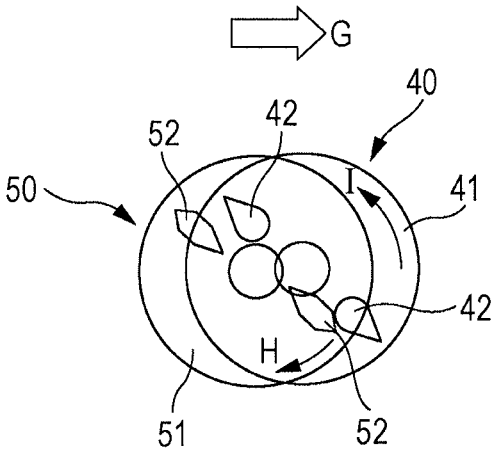
FIG. 6 is a diagram illustrating a problem that may occur in the case where the distance between two first projections and the distance between two second projections are approximately equal to each other.

FIG. 6 illustrates a comparative example and is a diagram illustrating a problem that may occur in the case where the distance between the two first projections 42 and the distance between the two second projections 52 are approximately equal to each other.

In order to transmit a driving force from the transmission member 40 to the receiving member 50 by correctly coupling the transmission member 40 and the receiving member 50 to each other, it is necessary that the two second projections 52 of the receiving member 50 move to positions opposite to each other with respect to the corresponding two first projections 42 of the transmission member 40 (on the same side in a rotation direction of the receiving member 50).

Here, as illustrated in FIG. 6, the two first projections 42 and the two second projections 52 are positioned so as to be inclined to the installation direction (direction of arrow G).

In this case, the proximal second projection 52 (the second projection 52 in the lower right of FIG. 6) abuts against a surface of the other one of the first projections 42 that is positioned further toward the proximal side in the installation direction (the first projection 42 in the lower right of FIG. 6), the surface being located on the downstream side in a rotation direction of the transmission member 40 (direction indicated by arrow I). The other one of the first projections 42 will hereinafter be referred to as a proximal first projection 42. Then, the receiving member 50 tries to rotate in a direction indicated by arrow H. However, the distal second projection 52 (the second projection 52 in the upper left of FIG. 6) abuts against the distal first projections 42 (the first projection 42 in the upper left of FIG. 6) this time, and it is difficult to correctly couple the transmission member 40 and the receiving member 50 to each other.

Figure 7A:
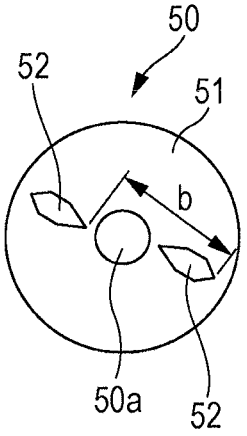
FIGS. 7A and 7B are schematic diagrams illustrating how to address the disadvantage illustrated in FIG. 6.
Figure 7B:
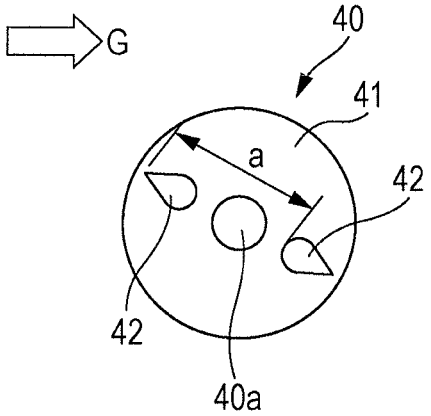

FIG. 7 is a schematic diagram illustrating how to address the disadvantage illustrated in FIG. 6.

Here, a distance between a first end of one of the two first projections 42, the first end being further away from the center of rotation 40*a* than a second end of the first projection 42, and a first end of the other one of the first projections 42, the first end being closer to the center of rotation 40*a* than a second end of the first projection 42, is a first distance a. A distance between a first end of one of the two second projections 52, the first end being further away from the center of rotation 50*a* than a second end of the second projection 52, and a first end of the other one of the second projections 52, the first end being closer to the center of rotation 50*a* than a second end of the second projection 52, is a second distance b. When the first distance a and the second distance b are compared, a relationship of a>b is satisfied. However, since this is an outline of how to address the disadvantage illustrated in FIG. 6, there is a case where desirable results are not obtained even if the relationship of a>b is barely satisfied. Therefore, it is necessary that the difference between the first distance a and the second distance b be slightly larger in order to satisfy a relationship of a>b+c (c>0).

Figure 8:
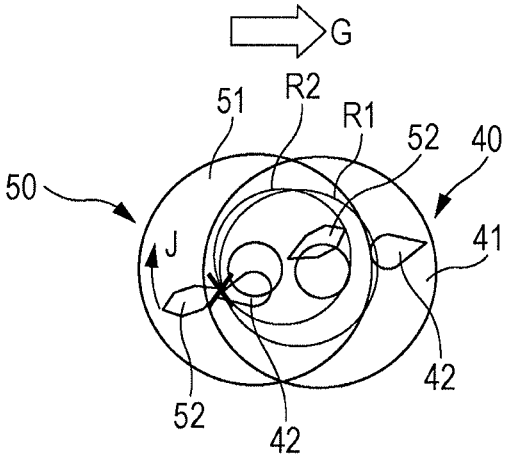
FIG. 8 is a diagram illustrating the case of addressing the disadvantage illustrated in FIG. 6 in the manner illustrated in FIG. 7.

FIG. 8 is a diagram illustrating the case of addressing the disadvantage illustrated in FIG. 6 in the manner illustrated in FIG. 7.

In FIG. 8, regarding the transmission member 40 and the receiving member 50, the two first projections 42 and the two second projections 52 are positioned so as to be oriented as illustrated in FIG. 8.

Assume that the toner cartridge 3 is installed in the installation direction (direction of arrow G), and the distal second projection 52 (the second projection 52 on the left side in FIG. 8) comes into contact with the distal first projections 42 (on the left side in FIG. 8) at a contact point X. Then, the receiving member 50 rotates in a direction indicated by arrow J. Here, a circle R2 having a diameter equal to a distance b' between the contact point X and a first end of the proximal second projection 52 (on the right side in FIG. 8), the first end being closer to the center of rotation 50*a* than a second end of the proximal second projection 52, is smaller than a circle R1 having a diameter equal to a distance a' between the contact point X and a first end of the proximal first projections 42 (on the right side in FIG. 8), the first end being closer to the center of rotation 40*a* than a second end of the proximal first projection 42. In other words, a relationship of a'>b' is satisfied.

Note that, although in the present exemplary embodiment, the printer 1 has been described as an example of the driving force transmission device of the present invention, the present invention is not limited to the printer 1 and image forming apparatuses other than the printer 1 and may be widely applied to apparatuses each of which includes a body, which transmits a driving force, and an installation unit, which receives the driving force by being installed in the body.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving force transmission mechanism comprising:

a body including a transmission member that transmits a driving force and includes a first surface, which rotates, and two first projections that project from the first surface at positions, each of which is spaced apart from a center of rotation of the first surface; and an installation unit that includes a receiving member including a second surface, which faces the first surface and which rotates as a result of receiving the driving force in a state where the installation unit is installed in the body, and two second projections, which project from the second surface at positions each of which is spaced apart from a center of rotation of the second surface and which receive the driving force from the first projections by being in contact with the first projections in accordance with rotation of the first surface, and that is configured to be removably installed in the body in a direction in which the second surface moves parallel to the first surface in such a manner that the transmission member and the receiving member are coupled to each other, wherein the body further includes a contact member that comes into contact with one of the second projections while the installation unit is being installed in the body in an installation direction intersecting with a rotation axis of the first surface and the second surface in a state where a line segment connecting the second projections intersects the installation direction and that causes the receiving member to rotate before the second projections come into contact with the first projections while the installation unit is being installed in the body in the installation direction.

2. The driving force transmission mechanism according to claim 1, wherein each of the first projections and each of the second projections have a first pointed portion that is tapered in a direction away from a corresponding one of the centers of rotation.

3. The driving force transmission mechanism according to claim 1, wherein each of the second projections has a second pointed portion that is tapered in a direction toward the corresponding center of rotation.

4. The driving force transmission mechanism according to claim 2, wherein each of the second projections has a second pointed portion that is tapered in a direction toward the corresponding center of rotation.

5. The driving force transmission mechanism according to claim 1, wherein a first distance between a first end of one of the two first projections, the first end being further away from the corresponding center of rotation than a second end of the first projection, and a first end of the other one of the first projections, the first end being closer to the corresponding center of rotation than a second end of the first projection, is larger than a second distance between a first end of one of the two second projections, the first end being further away from the corresponding center of rotation than a second end of the second projection, and a first end of the other one of the second projections, the first end being closer to the corresponding center of rotation than a second end of the second projection, and is a distance that causes, when one of the two second projections of the installation unit that is installed in the body via the contact member comes into contact with one of the two first projections, the receiving member to rotate without causing the other one of the two second projections to make contact with the other one of the two first projections of the body.

6. The driving force transmission mechanism according to claim 2, wherein a first distance between a first end of one of the two first projections, the first end being further away from the corresponding center of rotation than a second end of the first projection, and a first end of the other one of the first projections, the first end being closer to the corresponding center of rotation than a second end of the first projection, is larger than a second distance between a first end of one of the two second projections, the first end being further away from the corresponding center of rotation than a second end of the second projection, and a first end of the other one of the second projections, the first end being closer to the corresponding center of rotation than a second end of the second projection, and is a distance that causes, when one of the two second projections of the installation unit that is installed in the body via the contact member comes into contact with one of the two first projections, the receiving member to rotate without causing the other one of the two second projections to make contact with the other one of the two first projections of the body.

7. The driving force transmission mechanism according to claim 3, wherein a first distance between a first end of one of the two first projections, the first end being further away from the corresponding center of rotation than a second end of the first projection, and a first end of the other one of the first projections, the first end being closer to the corresponding center of rotation than a second end of the first projection, is larger than a second distance between a first end of one of the two second projections, the first end being further away from the corresponding center of rotation than a second end of the second projection, and a first end of the other one of the second projections, the first end being closer to the corresponding center of rotation than a second end of the second projection, and is a distance that causes, when one of the two second projections of the installation unit that is installed in the body via the contact member comes into contact with one of the two first projections, the receiving member to rotate without causing the other one of the two second projections to make contact with the other one of the two first projections of the body.

8. The driving force transmission mechanism according to claim 4, wherein a first distance between a first end of one of the two first projections, the first end being further away from the corresponding center of rotation than a second end of the first projection, and a first end of the other one of the first projections, the first end being closer to the corresponding center of rotation than a second end of the first projection, is larger than a second distance between a first end of one of the two second projections, the first end being further away from the corresponding center of rotation than a second end of the second projection, and a first end of the other one of the second projections, the first end being closer to the corresponding center of rotation than a second end of the second projection, and is a distance that causes, when one of the two second projections of the installation unit that is installed in the body via the contact member comes into contact with one of the two first projections, the receiving member to rotate without causing the other one of the two second projections to make contact with the other one of the two first projections of the body.

9. An image forming apparatus comprising:

the driving force transmission mechanism according to claim 1, wherein the installation unit is a powder container that contains a powder, and wherein the body is an image forming apparatus body that forms an image by using the powder contained in the powder container.

10. An image forming apparatus comprising:

the driving force transmission mechanism according to claim 2, wherein the installation unit is a powder container that contains a powder, and wherein the body is an image forming apparatus body that forms an image by using the powder contained in the powder container.

11. An image forming apparatus comprising:

the driving force transmission mechanism according to claim 3, wherein the installation unit is a powder container that contains a powder, and wherein the body is an image forming apparatus body that forms an image by using the powder contained in the powder container.

12. An image forming apparatus comprising:

the driving force transmission mechanism according to claim 4, wherein the installation unit is a powder container that contains a powder, and wherein the body is an image forming apparatus body that forms an image by using the powder contained in the powder container.

13. An image forming apparatus comprising:

the driving force transmission mechanism according to claim 5, wherein the installation unit is a powder container that contains a powder, and wherein the body is an image forming apparatus body that forms an image by using the powder contained in the powder container.

14. An image forming apparatus comprising:

the driving force transmission mechanism according to claim 6, wherein the installation unit is a powder container that contains a powder, and wherein the body is an image forming apparatus body that forms an image by using the powder contained in the powder container.

15. An image forming apparatus comprising:

the driving force transmission mechanism according to claim 7, wherein the installation unit is a powder container that contains a powder, and wherein the body is an image forming apparatus body that forms an image by using the powder contained in the powder container.

16. An image forming apparatus comprising:

the driving force transmission mechanism according to claim 8, wherein the installation unit is a powder container that contains a powder, and wherein the body is an image forming apparatus body that forms an image by using the powder contained in the powder container.

* * * * *